US008826647B2

(12) United States Patent
Gonze et al.

(10) Patent No.: US 8,826,647 B2
(45) Date of Patent: Sep. 9, 2014

(54) ELECTRICALLY HEATED FILTER REGENERATION METHODS AND SYSTEMS

(75) Inventors: Eugene V. Gonze, Pinckney, MI (US); Michael J. Paratore, Jr., Howell, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 285 days.

(21) Appl. No.: 12/768,071

(22) Filed: Apr. 27, 2010

(65) Prior Publication Data

US 2011/0258985 A1 Oct. 27, 2011

(51) Int. Cl.
*F01N 3/00* (2006.01)
*F01N 3/027* (2006.01)

(52) U.S. Cl.
CPC ..... *F01N 3/027* (2013.01)
USPC ..... 60/295; 60/274; 60/311

(58) Field of Classification Search
USPC ..... 60/299, 301, 277, 295, 311
See application file for complete search history.

(56) References Cited

U.S. PATENT DOCUMENTS

| | | | | |
|---|---|---|---|---|
| 2007/0283683 | A1* | 12/2007 | Bellinger | 60/285 |
| 2009/0071127 | A1* | 3/2009 | Gonze et al. | 60/286 |
| 2010/0229538 | A1* | 9/2010 | Bloms et al. | 60/295 |
| 2011/0066354 | A1* | 3/2011 | Cassani et al. | 701/103 |
| 2011/0252769 | A1* | 10/2011 | Crosbie | 60/274 |

FOREIGN PATENT DOCUMENTS

| | | | | |
|---|---|---|---|---|
| CN | 101387214 | A | 3/2009 | |
| CN | 101392678 | A | 3/2009 | |
| DE | 102008046704 | A1 | 4/2009 | |
| FR | 2873160 | A1 | 1/2006 | |
| JP | 5156929 | A | 6/1993 | |
| JP | 2000297626 | A * | 10/2000 | F01N 3/02 |

OTHER PUBLICATIONS

Translation of JP-2000-297626, Machine Translated on Jan. 4, 2012.*

* cited by examiner

*Primary Examiner* — Thomas Denion
*Assistant Examiner* — Patrick Maines
(74) *Attorney, Agent, or Firm* — Cantor Colburn LLP

(57) ABSTRACT

A method of regenerating a particulate filter is provided. The method includes estimating a stress level of the particulate filter; and selectively controlling current to a heater of the particulate filter based on the stress level.

8 Claims, 3 Drawing Sheets

ELECTRICALLY HEATED FILTER REGENERATION METHODS AND SYSTEMS

FIELD OF THE INVENTION

Exemplary embodiments of the present invention relate to regeneration methods and systems and, more specifically, to regeneration methods and systems for electrically heated particulate filters.

BACKGROUND

Exhaust gas emitted from an internal combustion engine, particularly a diesel engine, is a heterogeneous mixture that contains gaseous emissions such as carbon monoxide (CO), unburned hydrocarbons (HC) and oxides of nitrogen (NOx) as well as condensed phase materials (liquids and solids) that constitute particulate matter. Catalyst compositions typically disposed on catalyst supports or substrates may be provided in an internal combustion engine exhaust system to convert certain, or all of these exhaust constituents into non-regulated exhaust gas components.

Particulate filters (PF), remove the particulate matter from the exhaust gas. The particulate matter accumulates within the PF. The accumulated particulate matter causes an increase in exhaust system backpressure experienced by the engine. To address this increase, the PF is periodically cleaned, or regenerated. Regeneration of a PF in vehicle applications is typically automatic and is controlled by an engine or other controller based on signals generated by engine and/or exhaust system sensors. The regeneration event involves increasing the temperature of the PF to levels that are often above 600° C. in order to burn the accumulated particulates.

One method of generating the appropriate temperatures in the PF for regeneration includes delivering unburned HC to an oxidation catalyst device disposed upstream of the PF. The HC may be delivered by injecting fuel directly into the exhaust gas system or may be achieved by "over-fueling" or "late fueling" the engine resulting in unburned HC exiting the engine with the exhaust gas. The HC is oxidized in the oxidation catalyst device resulting in an exothermic reaction that raises the temperature of the exhaust gas. The heated exhaust gas travels downstream to the PF and burns the particulate accumulation. Such methods promote increased fuel consumption, which impacts overall fuel economy of the system.

Accordingly, it is desirable to provide systems and methods for regenerating a PF that will result in decreased fuel consumption.

SUMMARY OF THE INVENTION

In one exemplary embodiment, a method of regenerating a particulate filter is provided. The method includes estimating a stress level of the particulate filter; and selectively controlling current to a heater of the particulate filter based on the stress level.

The above features and advantages and other features and advantages of the present invention are readily apparent from the following detailed description of the invention when taken in connection with the accompanying drawings.

BRIEF DESCRIPTION OF THE DRAWINGS

Other objects, features, advantages and details appear, by way of example only, in the following detailed description of embodiments, the detailed description referring to the drawings in which.

DESCRIPTION OF THE EMBODIMENTS

Figure 1:
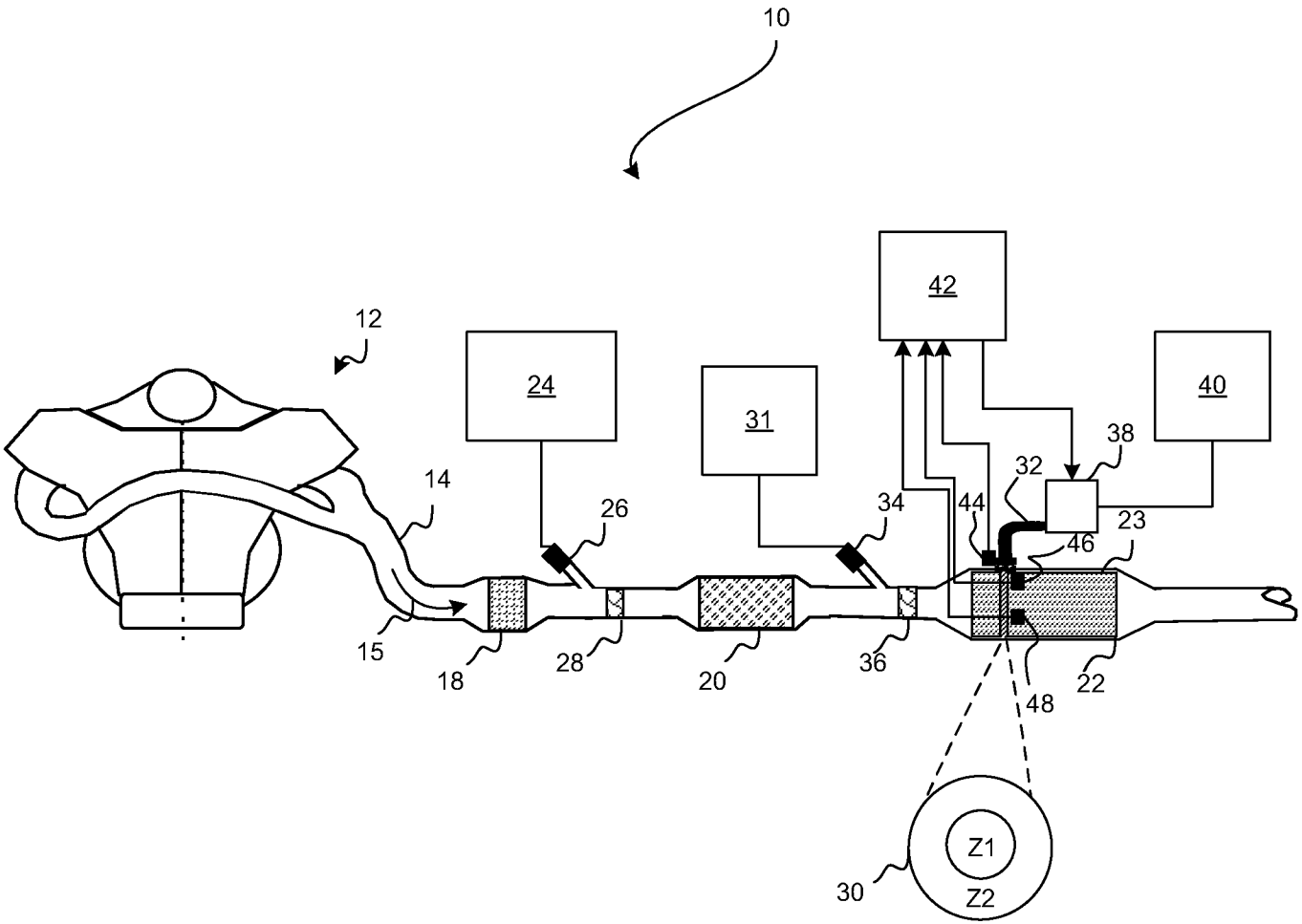
FIG. 1 is a schematic illustration of an exhaust system in accordance with an exemplary embodiment.

The following description is merely exemplary in nature and is not intended to limit the present disclosure, application or uses. It should be understood that throughout the drawings, corresponding reference numerals indicate like or corresponding parts and features. As used herein, the term module refers to an application specific integrated circuit (ASIC), an electronic circuit, a processor (shared, dedicated, or group) and memory that executes one or more software or firmware programs, a combinational logic circuit.

Referring now to FIG. 1, an exemplary embodiment is directed to an exhaust gas treatment system 10, for the reduction of regulated exhaust gas constituents of an internal combustion (IC) engine 12. The exhaust gas treatment system described herein can be implemented in various engine systems implementing a particulate filter. Such engine systems may include, but are not limited to, diesel engine systems, gasoline direct injection systems, and homogeneous charge compression ignition engine systems.

The exhaust gas treatment system 10 generally includes one or more exhaust gas conduits 14, and one or more exhaust treatment devices. The exhaust treatment devices include, for example, an oxidation catalyst device (OC) 18, a selective catalytic reduction device (SCR) 20, and a particulate filter device (PF) 22. As can be appreciated, the exhaust gas treatment system of the present disclosure may include the particulate filter device 22 and various combinations of one or more of the exhaust treatment devices shown in FIG. 1, and/or other exhaust treatment devices (not shown), and is not limited to the present example.

In FIG. 1, the exhaust gas conduit 14, which may comprise several segments, transports exhaust gas 15 from the IC engine 12 to the various exhaust treatment devices of the exhaust gas treatment system 10. The OC 18 may include, for example, a flow-through metal or ceramic monolith substrate that is wrapped in an intumescent mat or other suitable support that expands when heated, securing and insulating the substrate. The substrate may be packaged in a stainless steel shell or canister having an inlet and an outlet in fluid communication with exhaust gas conduit 14. The substrate can include an oxidation catalyst compound disposed thereon. The oxidation catalyst compound may be applied as a wash coat and may contain platinum group metals such as platinum (Pt), palladium (Pd), rhodium (Rh) or other suitable oxidizing catalysts, or combination thereof. The OC 18 is useful in treating unburned gaseous and non-volatile HC and CO, which are oxidized to form carbon dioxide and water.

The SCR 20 may be disposed downstream of the OC 18. In a manner similar to the OC 18, the SCR 20 may also include, for example, a flow-through ceramic or metal monolith substrate that is wrapped in an intumescent mat or other suitable support that expands when heated, securing and insulating the substrate. The substrate may be packaged in a stainless steel shell or canister having an inlet and an outlet in fluid communication with exhaust gas conduit 14. The substrate can include an SCR catalyst composition applied thereto. The SCR catalyst composition can contain a zeolite and one or more base metal components such as iron (Fe), cobalt (Co), copper (Cu) or vanadium which can operate efficiently to convert NOx constituents in the exhaust gas 15 in the presence of a reductant such as ammonia ($NH_3$).

An $NH_3$ reductant may be supplied from a reductant supply source 24 and may be injected into the exhaust gas conduit 14 at a location upstream of the SCR 20 using an injector 26, or other suitable method of delivery of the reductant to the exhaust gas 15. The reductant may be in the form of a gas, a liquid, or an aqueous urea solution and may be mixed with air in the injector 26 to aid in the dispersion of the injected spray. A mixer or turbulator 28 may also be disposed within the exhaust conduit 14 in close proximity to the injector 26 to further assist in thorough mixing of the reductant with the exhaust gas 15.

The PF 22 may be disposed downstream of the SCR 20. The PF 22 operates to filter the exhaust gas 15 of carbon and other particulates. In various embodiments, the PF 22 may be constructed using a ceramic wall flow monolith filter 23 that is wrapped in an intumescent mat or other suitable support that expands when heated, securing and insulating the filter 23. The filter 23 may be packaged in a shell or canister that is, for example, stainless steel, and that has an inlet and an outlet in fluid communication with exhaust gas conduit 14. The ceramic wall flow monolith filter 23 may have a plurality of longitudinally extending passages that are defined by longitudinally extending walls. The passages include a subset of inlet passages that have and open inlet end and a closed outlet end, and a subset of outlet passages that have a closed inlet end and an open outlet end. Exhaust gas 15 entering the filter 23 through the inlet ends of the inlet passages is forced to migrate through adjacent longitudinally extending walls to the outlet passages. It is through this wall flow mechanism that the exhaust gas 15 is filtered of carbon and other particulates. The filtered particulates are deposited on the longitudinally extending walls of the inlet passages and, over time, will have the effect of increasing the exhaust gas backpressure experienced by the IC engine 12. It is appreciated that the ceramic wall flow monolith filter is merely exemplary in nature and that the PF 22 may include other filter devices such as wound or packed fiber filters, open cell foams, sintered metal fibers, etc.

The accumulation of particulate matter within the PF 22 is periodically cleaned, or regenerated. Regeneration involves the oxidation or burning of the accumulated carbon and other particulates in what is typically a high temperature (>600° C.) environment.

For regeneration purposes, an electrically heated device (EHD) 30 is disposed within the canister of the PF 22. In various embodiments, the EHD 30 is located at or near the inlet of the filter 23. The EHD 30 may be constructed of any suitable material that is electrically conductive such as a wound or stacked metal monolith. An electrical conduit 32 that is connected to an electrical system, such as a vehicle electrical system, supplies electricity to the EHD 30 to thereby heat the device. The EHD 30, when heated, increases the temperature of exhaust gas 15 passing through the EHD 30 and/or increases the temperature of portions of the filter 23 at or near the EHD 30. The increase in temperature provides the high temperature environment that is needed for regeneration.

In various embodiments an oxidation catalyst compound (not shown) may be applied to the EHD 30 as a wash coat and may contain platinum group metals such as platinum (Pt), palladium (Pd), rhodium (Rh) or other suitable oxidizing catalysts, or combination thereof. Fuel may be supplied from a fuel supply source 31 and may be injected into the exhaust gas conduit 14 at a location upstream of the PF 22 using an injector 34. The fuel may be in the form of a gas or liquid and may be mixed with air in the injector 34 to aid in the dispersion of the injected spray. A mixer or turbulator 36 may also be disposed within the exhaust conduit 14 in close proximity to the injector 34 to further assist in thorough mixing of the fuel with the exhaust gas 15. The oxidation catalyst of the EHD 30 oxidizes the HC of the fuel, resulting in an exothermic reaction that raises the temperature of the exhaust gases 15 passing through the filter 23.

In various embodiments, as shown in the enlarged sectional view of FIG. 1, the EHD 30 is segmented into one or more zones that can be individually heated. For example, the EHD 30 can include a first zone Z1, also referred to as a center zone, and a second zone Z2, also referred to as a perimeter zone. As can be appreciated, the EHD 30 can include any number of zones. For ease of the discussion, the disclosure will be discussed in the context of the exemplary center zone Z1 and the perimeter zone Z2.

As shown in FIG. 1, a switching device 38 that includes one or more switches is selectively controlled to allow current to flow from a vehicle power source 40 through the electrical conduit 32 to the zones Z1, Z2 of the EHD 30. A control module 42 may control the IC engine 12 and the switching device 38 based on sensed and/or modeled data. Such sensed information can be, for example, temperature information indicating a temperature of exhaust gas 15 and/or temperatures of various elements within the PF 22. The sensed information can be received from temperature sensors 44, 46, 48.

In various embodiments, the control module 42 controls regeneration by controlling the flow of current through the switching device 38 to the EHD 30 based on a multiple stage regeneration strategy. Such multiple stage regeneration strategy can include, for example, an early stage where current is controlled according to a first method during an early stage of regeneration; and a later stage where current is controlled according to a second method during a later stage of regeneration. The control module 42 determines the early stage based on a stress level of the substrate of the filter 23 that is in proximity to one or more of the zones Z1, Z2. The control module 42 determines the later stage based on a completion of the early stage. As can be appreciated, the multiple stage regeneration strategy can include any number of stages that are determined based on the stress level of the filter 23 and a completion of regeneration. For ease of discussion, the remainder of the disclosure is discussed in the context of the exemplary two stage regeneration strategy. Controlling regeneration based on the multiple stage regeneration strategy allows regeneration to begin at temperatures lower than typical regeneration strategies.

Figure 2:
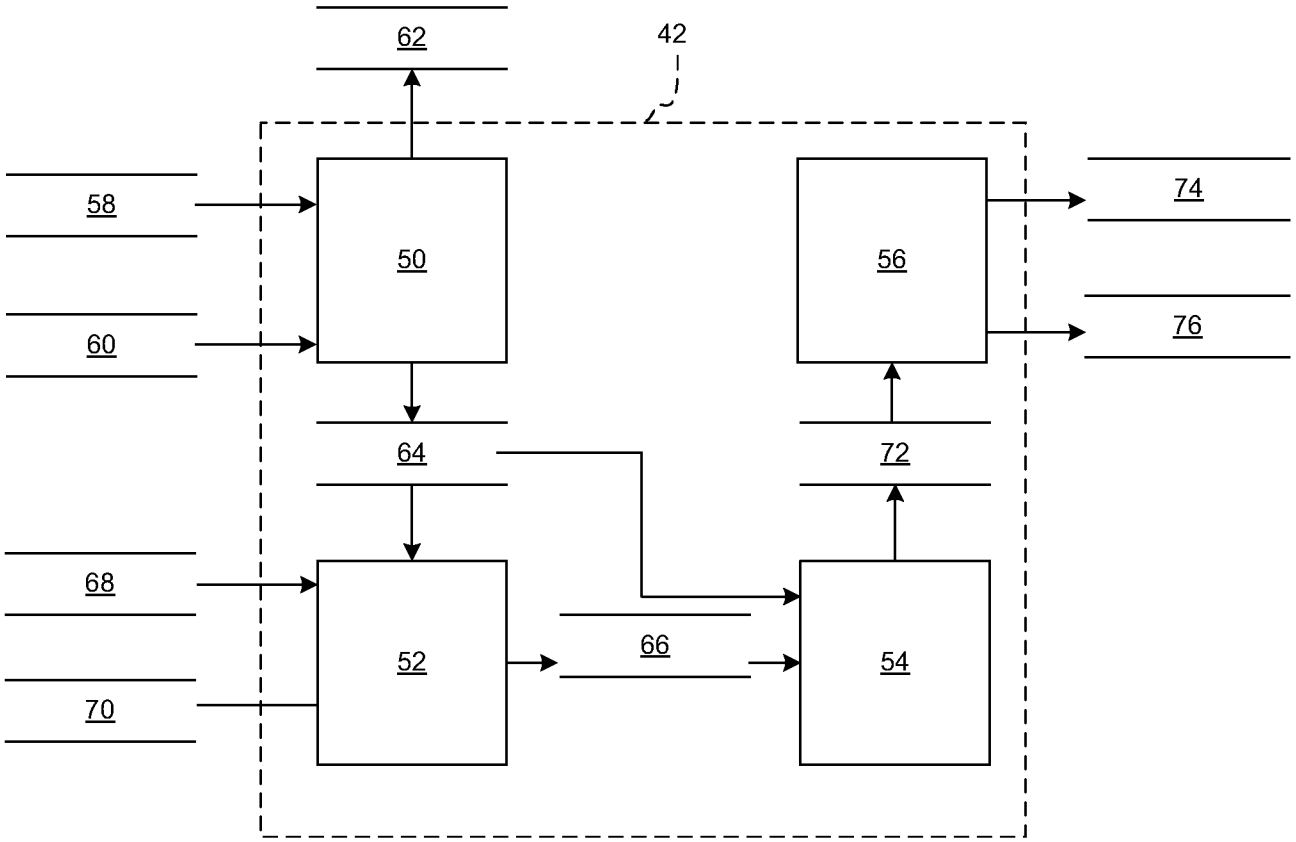
FIG. 2 is a dataflow diagram illustrating a regeneration control system in accordance with an exemplary embodiment.

Referring now to FIG. 2, a dataflow diagram illustrates various embodiments of a particulate filter regeneration system that may be embedded within the control module 42. Various embodiments of particulate filter regeneration systems according to the present disclosure may include any number of sub-modules embedded within the control module 42. As can be appreciated, the sub-modules shown in FIG. 2 may be combined and/or further partitioned to similarly control regeneration of the PF 22 (FIG. 1). Inputs to the system may be sensed from the IC engine 12 (FIG. 1), received from other control modules (not shown), and/or determined/modeled by other sub-modules (not shown) within the control module 42. In various embodiments, the control module 42 includes a regeneration evaluation module 50, a stress estimator module 52, a stress evaluator module 54, and a heater control module 56.

The regeneration evaluation module 50 determines when regeneration can begin. For example, the regeneration evaluation module 50 determines if regeneration is desired and, if desired, determines whether the exhaust temperature is sufficient to begin regeneration. In various embodiments, the regeneration evaluation module 50 determines if regeneration is desired based on a soot level 58 indicating an amount of soot in the PF 22 (FIG. 1). If the soot level 58 is above a predetermined threshold, then regeneration is desired. In various embodiments, the regeneration evaluation module 50 determines if the exhaust temperature is sufficient (e.g., greater than a predetermined threshold, >450° C.) based on a sensed temperature 60 of the exhaust gas 15. If the exhaust temperature 60 is not sufficient (e.g., less than the predetermined threshold, <450° C.) and regeneration is desired, the regeneration evaluation module 50 can generate one or more fuel control signals 62 that increases the amount of fuel in the exhaust gas 15, to increase the exhaust temperature 60.

Once the exhaust temperature 60 reaches the predetermined threshold, the regeneration evaluation module 50 indicates that regeneration can be begin, for example, by setting a regeneration flag 64 to TRUE. (Otherwise, the regeneration flag 64 remains set to FALSE.)

The stress estimator module 52 estimates a stress level of the filter 23 within the PF 22 (FIG. 1). For example, the stress estimator module 52 receives as input various data indicating current conditions of the PF 22 (FIG. 1). In one example, the stress estimator module 52 may receive as input a first temperature 68 indicating a temperature of a first zone Z1 (e.g., a center zone) of the particulate filter 23, and a second temperature 70 indicating a temperature of a second zone Z2 (e.g., a perimeter zone) of the filter 23. The stress estimator module 52 estimates the stress level 66 on the overall substrate or within a particular zone of the substrate based on the first and second temperatures 68, 70. In one example, the stress estimator module 52 estimates the stress level 66 based on the thermal expansion of the substrate. For example, substrate stress estimator module 52 estimates the thermal expansion based on the following equation:

$$T=\alpha*\Delta T*E(\text{Area}). \quad (1)$$

Where the symbol $\alpha$ represents a coefficient of expansion. The symbol $\Delta T$ represents the delta between the first temperature 68 and the second temperature 70. The symbol E represents the Young's Modulus equation.

The stress evaluator module 54 determines the stage 72 of regeneration based on the stress level 66 on the substrate. For example, the stress evaluator module 54 receives as input the estimated stress level 66, and the regeneration flag 64. Based on the estimated stress level 66, and the regeneration flag 64, the stress evaluator module 54 determines the regeneration stage 72. In various embodiments, the regeneration stage 72 can be the early stage, the later stage, or no regeneration.

For example, the stress evaluator module 54 determines the stage to be the no regeneration when the regeneration flag 64 is FALSE (e.g., regeneration is not desired or is not ready to begin). Once the regeneration flag 64 becomes TRUE, the stress evaluator module 54 determines the stage 72 to be one of the early stage and the later stage. For example, if the estimated stress level 66 is below a predetermined threshold level and regeneration of the center zone has not yet occurred, the stress evaluator module 54 determines the stage 72 to be the early stage. Once regeneration of the center zone has completed, the stress evaluator module 54 determines the stage 72 to be the later stage.

The heater control module 56 receives as input the regeneration stage 72. Based on the regeneration stage 72, the heater control module 56 controls the flow of current to the EHD 30 (FIG. 1). In one example, if the stage 72 is the early stage, the heater control module 56 controls the switching device 38 (FIG. 1) via a first control signal 74 to allow current to flow to the center zone Z1 (FIG. 1) of the EHD 30 (FIG. 1). In another example, if the stage 72 is the later stage, the heater control module 56 controls the switching device 38 (FIG. 1) via a second control signal 76 to allow current to flow to the perimeter zone Z2 (FIG. 1) of the EHD 30 (FIG. 1). As can be appreciated, the particular zone that is heated for the particular stage can vary and is not limited to the present example.

Figure 3:
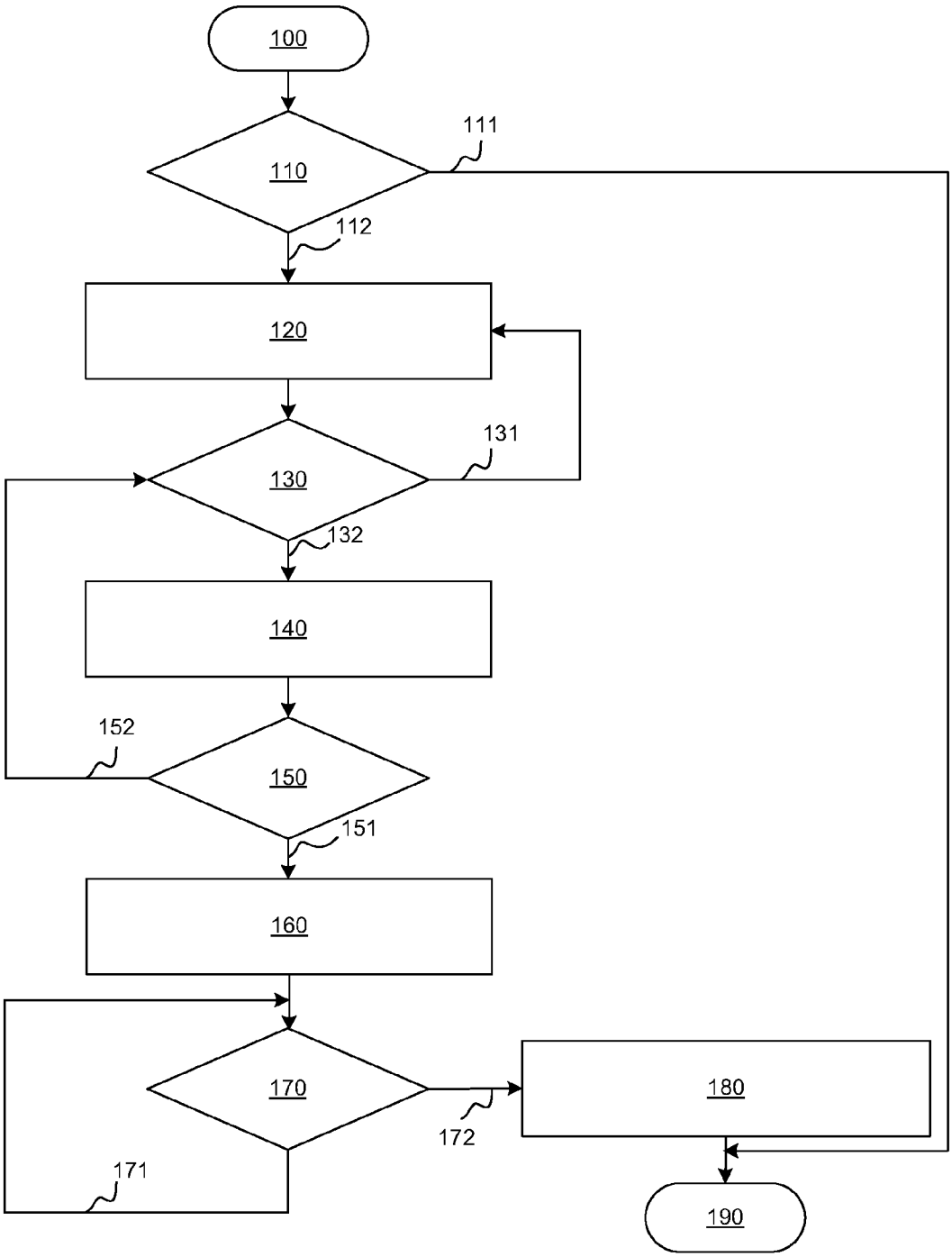
FIG. 3 is a flowchart illustrating a regeneration control method in accordance with an exemplary embodiment.

Referring now to FIG. 3, and with continued reference to FIGS. 1 and 2, a flowchart illustrates a regeneration control method that can be performed by the control module 42 of FIG. 1 in accordance with the present disclosure. As can be appreciated in light of the disclosure, the order of operation within the method is not limited to the sequential execution as illustrated in FIG. 3, but may be performed in one or more varying orders as applicable and in accordance with the present disclosure.

In various embodiments, the method can be scheduled to run based on predetermined events, and/or run continually during operation of the IC engine 12.

In one example, the method may begin at 100. The desirability of PF regeneration is evaluated at 110, for example, based on the accumulated soot level 58 in the PF 22. If PF regeneration is not desired at 111, the stage 72 is the no regeneration stage and the method may end at 190.

However, if PF regeneration is desired at 112, the exhaust temperature 60 is elevated at 120, for example, based on a fuel control strategy. The exhaust temperature 60 is then evaluated at 130. If the exhaust temperature 60 is less than or equal to a temperature threshold at 131, the method continues with elevating the exhaust temperature 60 until the temperature threshold is met at 130.

Once the exhaust temperature 60 is greater than the predetermined threshold at 132, the stress level 66 of the substrate is estimated at 140 based on, for example, the thermal expansion of all or part of the substrate. Once the stress level 66 has been estimated at 140, the stress level 66 is evaluated at 150. If the stress level 66 is less than a predetermined threshold at 151, the stage is the early stage and the switching device 38 is controlled to allow current flow to the center zone Z1 at 160. However, if the stress level 66 is greater than or equal to the predetermined threshold at 152, the method continues with evaluating the exhaust temperature 60 at 130.

The regeneration is evaluated at 170. If regeneration is not complete at 171, the method continues to evaluate the regeneration at 170. Once the early regeneration is complete at 172, the switching device 38 is controlled to allow current flow to the perimeter zone Z2 at 180. Once the later stage regeneration is complete, the method may end at 190.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the present application.

What is claimed is:

1. An exhaust system, comprising:

a particulate filter that includes an electric heater; and an electronic control module including operative logic which when implemented estimates a stress level of a substrate of the particulate filter, and is configured to:

estimate the stress level of the particulate filter substrate;

generate a signal indicative of the estimated stress level;

evaluate whether the estimated stress level signal is below a predetermined threshold;

determine a regeneration stage based on the stress level signal evaluation;

generate an early stage regeneration signal if the estimated stress level signal is determined to be below the predetermined threshold;

perform an early stage regeneration, based on the early stage regeneration signal, by flowing current to a first zone of the electric heater;

generate a late stage regeneration signal when the early stage regeneration is complete; and perform a late stage regeneration, based on the late stage regeneration signal, by flowing current to a second zone of the heater.

2. The system of claim 1 wherein the control module estimates the stress level based on an estimated thermal expansion of the substrate of the particulate filter.

3. The system of claim 1 wherein the control module estimates the stress level based on a temperature differential within the particulate filter.

4. The system of claim 1 wherein flowing current to the first zone comprises flowing current to a center zone of the electric heater.

5. The system of claim 1 wherein flowing current to the second zone comprises flowing current to a perimeter zone of the electric heater.

6. A method of regenerating a particulate filter having a substrate, the method comprising:

estimating a stress level of the particulate filter substrate;

generating a signal indicative of the estimated stress level;

evaluating whether the estimated stress level signal is below a predetermined threshold;

determining a regeneration stage based on the stress level signal evaluation;

generating an early stage regeneration signal if the estimated stress level signal is determined to be below the predetermined threshold;

performing an early stage regeneration, based on the early stage regeneration signal, by flowing current to a center zone of a heater;

generating a late stage regeneration signal when the early stage regeneration is complete; and performing a late stage regeneration, based on the late stage regeneration signal, by flowing current to a perimeter zone of the heater.

7. The method of claim 6, wherein:

said estimating a stress level comprises estimating a stress level of the particulate filter substrate with a stress estimator module, the stress estimator module estimating the stress level based on a thermal expansion of the substrate; and said receiving a signal comprises receiving, with a stress evaluator module, an estimated stress level signal from the stress estimator module.

8. The method of claim 6, further comprising, prior to said estimating a stress level:

determining if regeneration of the particulate filter is desirable;

determining if a temperature of an exhaust gas is less than or equal to a first temperature threshold;

elevating the exhaust gas temperature if the exhaust gas temperature is less than or equal to the first temperature threshold; and determining if the temperature of the exhaust gas is greater than a second temperature threshold, wherein said step of estimating a stress level comprises estimating a stress level of the particulate filter when the exhaust gas temperature is greater than the second temperature threshold.

* * * * *